US006573882B1

(12) United States Patent
Takabayashi

(10) Patent No.: US 6,573,882 B1
(45) Date of Patent: Jun. 3, 2003

(54) PICTURE DISPLAY METHOD USING LIQUID CRYSTAL DEVICE

(75) Inventor: Hiroshi Takabayashi, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/573,552

(22) Filed: May 19, 2000

(30) Foreign Application Priority Data

May 20, 1999 (JP) ..... 11-140513

(51) Int. Cl.[7] ..... G09G 3/36

(52) U.S. Cl. ..... 345/102; 345/88; 345/690; 345/87; 345/100; 345/84; 349/61; 349/68; 349/70; 349/72

(58) Field of Search ..... 345/102, 88, 98, 345/202, 87, 100, 690, 691, 692, 693, 84; 349/61, 84, 68, 70; 315/119, 225, 307

(56) References Cited

U.S. PATENT DOCUMENTS 5,359,345 A * 10/1994 Hunter ..... 345/102
5,731,794 A * 3/1998 Miyazawa ..... 345/88
5,808,597 A 9/1998 Onitsuka et al. ..... 345/102
5,828,362 A 10/1998 Takahashi et al. ..... 345/153
6,151,004 A * 11/2000 Kaneko ..... 345/88

FOREIGN PATENT DOCUMENTS

| | | |
|---|---|---|
| JP | 63-41078 | 2/1988 |
| JP | 7-41023 | 5/1995 |
| JP | 8-101672 | 4/1996 |
| JP | 8-248381 | 9/1996 |
| JP | 8-317380 | 11/1996 |
| JP | 9-90196 | 4/1997 |

* cited by examiner

*Primary Examiner*—Richard Hjerpe
*Assistant Examiner*—Ah Zamani
(74) *Attorney, Agent, or Firm*—Fitzpatrick, Cella, Harper & Scinto

(57) ABSTRACT

A liquid crystal device is sequentially illuminated with three primary color lights in three primary color illumination steps including an off period (1) before, (2) before and after and (3) after the primary color light period, respectively. As a result, each primary color light illumination step includes a black picture display period corresponding to the off period, whereby motion picture blurring and color splitting can be suppressed without requiring a complicated circuit for generating new data for the black picture display.

4 Claims, 3 Drawing Sheets

PICTURE DISPLAY METHOD USING LIQUID CRYSTAL DEVICE

FIELD OF THE INVENTION AND RELATED ART

The present invention relates to a method of displaying a color picture by using a liquid crystal device, particularly a picture display method using a liquid crystal device for effecting color picture display by illuminating a liquid crystal device sequentially with R (red), G (green) and B (blue) lights in synchronism with optical switching by the liquid crystal device so as to sequentially display picture of R, G and B respective colors.

Hitherto, color picture display has been practiced by using liquid crystal device according to methods including the following methods (1) and (2).

(1) A method of continuously illuminating a liquid crystal device equipped with a color filter with white light. Each pixel of the liquid crystal device corresponds to one color filter segment (one of R, G and B). The respective pixels are disposed in division in sizes not discriminable with eyes (spatial division), and respective color rights of R, G and B from these pixels are mixed through the simultaneously additive process to be observed as a color picture.

(2) A method of color picture display using a display apparatus as illustrated in FIG. 4 which is a schematic diagram representing a known liquid crystal display apparatus. Referring to FIG. 4, the display apparatus includes a light source 1 for emitting respective color lights of R, G and B, a liquid crystal device 3 to be illuminated with the color lights and a picture-switching means 2 for controlling the liquid crystal device 3. In picture display, the liquid crystal device 3 is illuminated sequentially (in time division) with respective color lights of R, G and B from the light source 1 while effecting light switching by the liquid crystal device 3 in synchronism with the respective color light illumination under control by the picture switching means 2. The respective color lights of R, G and B from the liquid crystal device 3 are mixed through the sequential additive process to be recognized as a color picture. This type of color display method is, e.g., disclosed in Japanese Patent Publication (JP-B) 63-41078.

Of the above-mentioned methods (1) and (2), the method (2) is advantageous in that one pixel of the liquid crystal device allows a color given by a mixture of R, G and B, thus allowing a higher resolution display.

The above-mentioned method (2) is however accompanied with the following problems (a) and (b).

(a) Motion picture blurring. This problem is explained with reference to FIG. 5A. It is assumed that a picture G moves rightward from time n to time n+1 as illustrated in FIG. 5A. If the moving picture G is followed by observation with eyes, both edge portions (hatched portions) of the moved picture are blurred due to an after image effect occurring in the eyes. A blurring of a motion picture is caused due to a restriction in eye detection speed. This problem also occurs in the method (1).

The problem has been reported in a paper entitled "Motion Blurring Obstruction in Hold-Type Picture Display (in Japanese) (Collection of Papers at Electronic Communication Society, Japan, '85/12 vol. J68-B No. 12). The paper contains a description to the effect that "Detection eye speed on blurring obstruction accompanying picture motion is governed by a light emission time at a pixel."

In recent years, the blurring has been quantitatively evaluated. For example, a paper entitled "Study on Motion Picture Quality in Hold Emission-Type Display by Eight-times Accelerated CRT (in Japanese)" ("Shin-Gaku Giho" EID 96-4 (1996-06)) contains a description to the effect that "In the hold-type, the evaluation subsides below an allowable limit at a speed of 13.6 deg/sec."

(b) Color splitting. This problem is explained with reference to FIG. 5B. It is again assumed that a color picture G moves rightward from time n to time n+1 as illustrated in FIG. 5B. If the moving color picture G is followed by observation with eyes, both edge portions (hatched portions at the display position) cause blurring of colors due to mixing of colors recognized by after image effect by eyes of a previous display before the motion with colors of a current display after the motion. This problem of color splitting is peculiar in the method (2).

The color splitting is also a problem attributable to a restriction in eye detection speed of a motion picture. This problem is discussed in, e.g., JP-B 7-41023, Japanese Laid-Open Patent Application (JP-A)8-248381, JP-A 8-317380, JP-A 8-101672 and JP-A 9-90196. (In some of these documents, a term "color deviation" is used instead of "color splitting" for an identical phenomenon.)

Several proposals have been made for solving the above-mentioned problems, but they are also accompanied with other problems as described below:

(i) For solving the problem of color splitting, JP-B 7-41023 has proposed a detection device using an electric circuit, but the proposal requires a complicated circuit and yet is unsuitable for processing a high-speed motion picture.

(ii) JP-A 8-248381 has proposed to use a succession of fields having different time orders of color signals, particularly so that the color of a final color signal in a preceding period is made identical to the color of a first color signal in a subsequent period. This however results in a lower frame frequency for the other color data, thus being liable to cause flicker.

(iii) JP-A 8-317380 has proposed a 3:1-interlaced scanning for causing different colors at an identical position on a scanning line. The use of such a special scanning scheme requires a complicated circuit system.

(iv) JP-A 8-101672 has proposed to utilize a non-chromatic color signal derived from R, G and B signals, but the preparation of such new picture data requires a complicated circuit.

(v) JP-A 9-90916 has proposed to form a sub-field of white or intermediate color of a period identical to the fields of R, G and B in addition to the R, G and B fields. The preparation of new picture data requires a complicated circuit, and the newly prepared sub-field of white or intermediate color is liable to deteriorate the picture quality.

Among the above-mentioned proposals (i) to (v), the proposals (iv) and (v) using non-chromatic picture data or white picture data are advantageous in that they are applicable to processing of high-speed motion picture without causing flicker and without utilizing a special scanning scheme. However, the preparation of new picture data to be inserted still involves a problem that the complication of circuit is inevitable.

SUMMARY OF THE INVENTION

In view of the above-mentioned circumstances of prior art, a principal object of the present invention is to provide a picture display method using a liquid crystal device capable of reducing the motion picture blurring and color splitting without requiring a complicated circuit.

According to the present invention, there is provided a color picture display method using a liquid crystal display apparatus of the type including a light source capable of emitting three primary color lights including first color light, second color light and third color light separately at arbitrary time, and a liquid crystal device for receiving and selectively switching the three primary color lights from the light source; said method comprising:

(A) illumination steps by using the light source including:

a first step of turning off the light source, and then emitting only the first color light, a second step of turning off the light source, then emitting only the second color light, and then turning off the light source, and a third step of emitting only the third color light and then turning off the light source, and (B) a liquid crystal device drive step of driving the liquid crystal device for optical switching in synchronism with the illumination steps to display a picture of the first color in the first step, a picture of the second color in the second step and a picture of the third color in the third step.

In a preferred embodiment, the first to third steps have equal lengths of period, include an equal length of period for emitting the color light and include an equal length of period for turning off the light source.

As a result, a black picture is displayed at the time of turning off the light source to effectively suppress the motion picture blurring and color splitting.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 4:
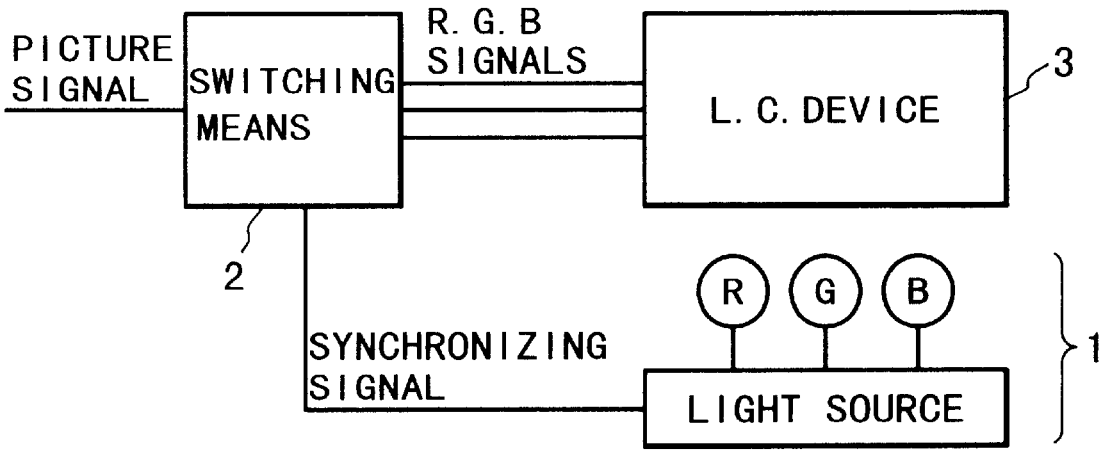
FIG. 4 is a block diagram of a liquid crystal color display apparatus.

The basic organization of a display apparatus used in the present invention is substantially identical to the one described with reference to FIG. 4 regarding the prior art.

Figure 1:
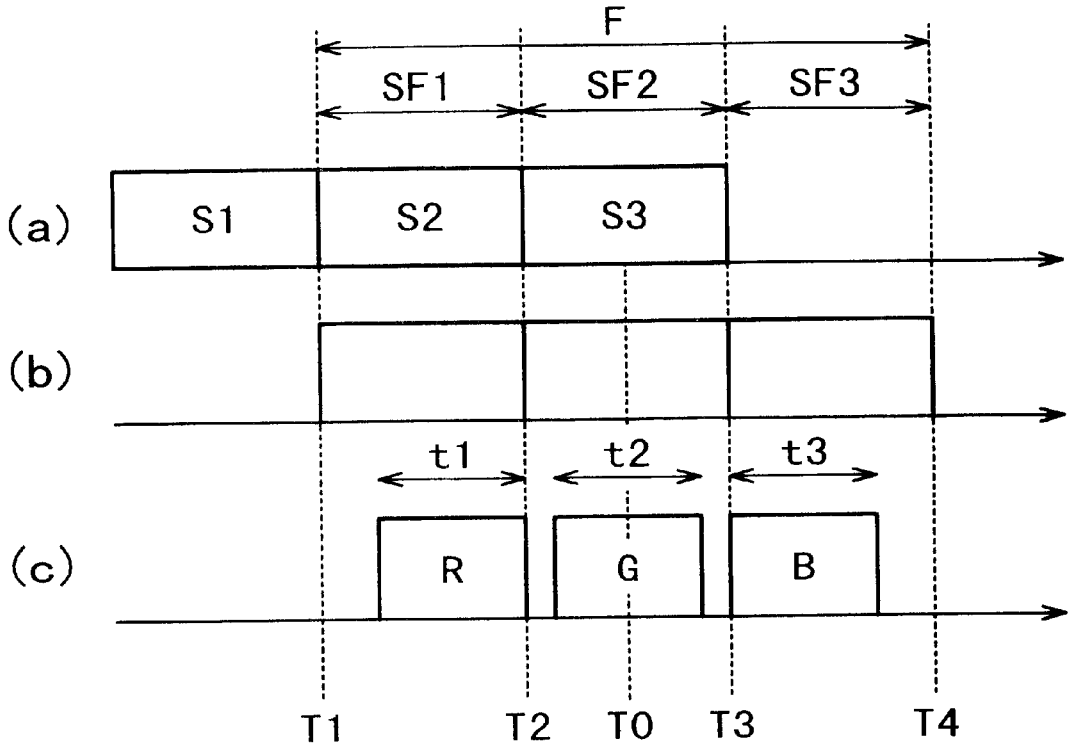
FIG. 1 is a time chart for illustrating an embodiment of the picture display method according to the invention.
Figure 5A:
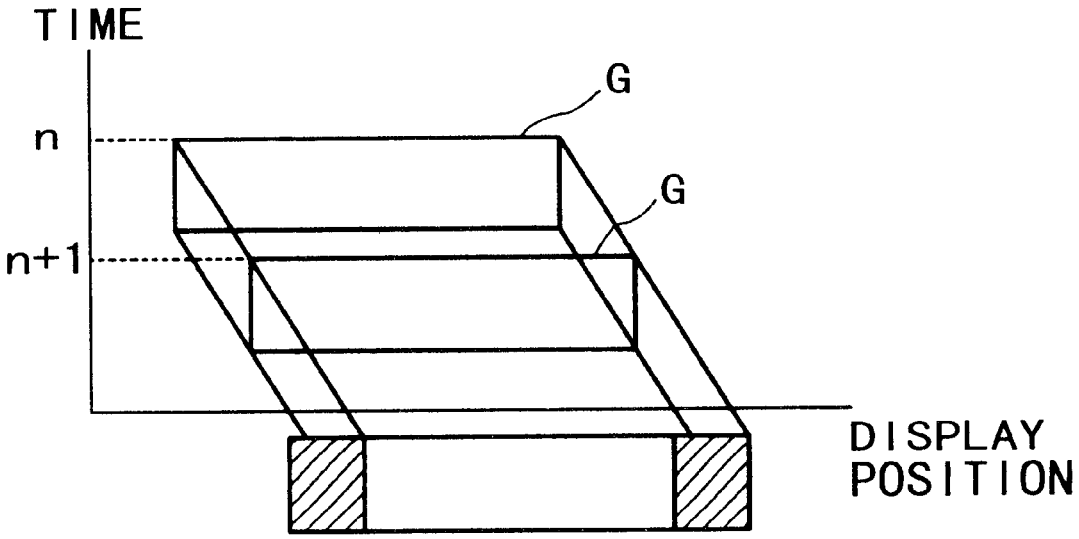
FIGS. 5A and 5B are graphical illustrations of motion picture blurring and color splitting in a liquid crystal display apparatus.
Figure 5B:
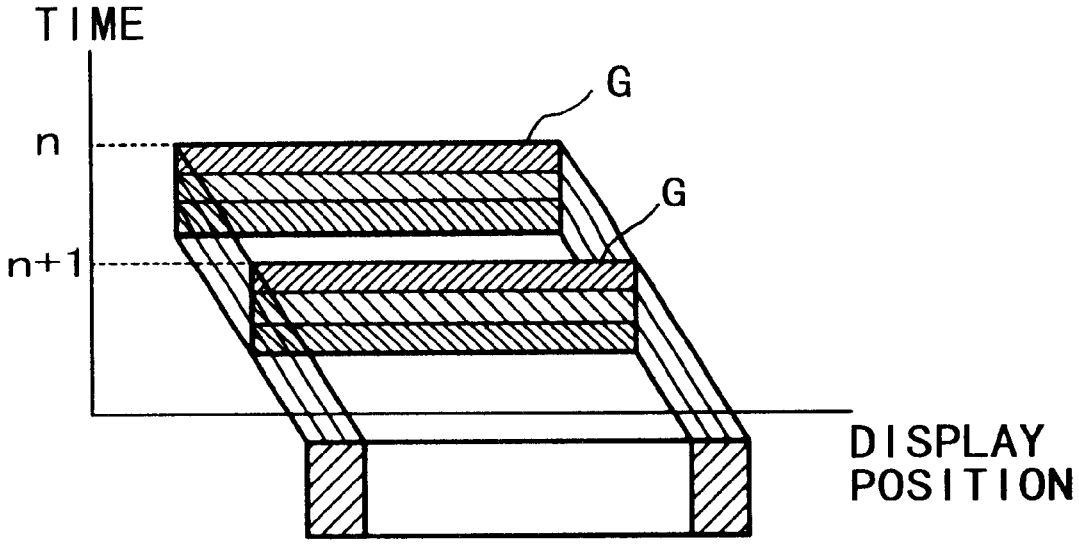

FIG. 1 is a time chart for illustrating an embodiment of the picture display method according to the present invention. Referring to FIG. 1, at (a) is shown time for reading data for switching by a liquid crystal device 3 (FIG. 5); at (b) is shown time for switching by the liquid crystal device 3; and at (c) is shown time for turning on and turning off a light source 1. As shown in FIG. 1, one field F is a period for display one frame of picture, and one field is divided into three equal sub-fields of a first sub-field SF1, a second sub-field SF2 and a third sub-field SF3. Accordingly, in the case of effecting a picture display by using a plurality of fields F, these first sub-field SF1, second sub-field SF2 and third sub-field SF3 are sequentially repeated.

Accordingly, for displaying a color picture by using the display apparatus, the data reading for switching by the liquid crystal device is sequentially performed with respect to picture data S1, S2 and S3 corresponding to the sub-fields SF1, SF2 and SF3, respectively. The data S1, S2 and S3 are read earlier by a period of nearly one sub-field than the switching sub-fields SF1, SF2 and SF3, respectively.

The liquid crystal device 3 is driven for switching in the sub-fields SF1 to SF3 based on the corresponding picture data S1 to S3. In synchronism with the switching by the liquid crystal device 3, the light source 1 is turned on and off. By turning on the light source 1, the liquid crystal device 3 is illuminated with red light (R) in the first sub-field SF1, green light (G) in the second sub-field SF2, and blue light (B) in the third field SF3. Herein, red (R), green (G) an blue (B) are three primary colors of light. In the respective sub-fields SF1 to SF3, the liquid crystal device 3 effects light switching, so that a red picture, a green picture and a blue picture are displayed in the first to third sub-fields SF1, SF2 and SF3, respectively, and these respective color pictures are additively mixed sequentially to be recognized as a full-color image over a one field F.

The sequence of turning on and off of the light source 1 is described in further detail. As shown at FIG. 1(*c*), in the first sub-field SF1, the light source 1 is turned off from the beginning (time T1) and then turned on to illuminate the liquid crystal device 3 with only red light (R) for time t1 until the end (time T2). In the second sub-field SF2, the light source 1 is turned off from the beginning (time T2), then turned on to illuminate the liquid crystal device 3 with only green light (G) for time t2, and then turned off until the end (time T3). In the third sub-field SF3, the light source 1 is turned on from the beginning (time T3) to illuminate the liquid crystal device 3 with only blue light (B) for time t3 and then turned off until the end (time T4).

As a result, the color splitting can be suppressed by shortening the OFF period between the lighting sub-fields in one field, and the motion picture blurring can be reduced by broadening the OFF period between successive fields.

Incidentally, in the above-mentioned embodiment, the lighting periods t1, t2 and t3 of the light source 1 for the first to third sub-fields SF1 and SF3 are set to be equal. Further, in the second sub-field SF2, the light source 1 is turned off for identical periods before and after the ON period which is also divided into equal halves by a central time T0 in the second sub-field SF2.

As a result of the above operation, in the respective sub-fields SF1 to SF3, the liquid crystal device 3 is not illuminated with any light when the light source 1 is turned off. In other words, during one field period F, a back picture is inserted respectively after a red picture display, after a green picture display and after a blue picture display. The insertion of a black picture (i.e., non-chromatic picture) has been known to suppress the blurring and the color splitting. Based on the effects which per se have been known, the above embodiment including insertion of a back picture in one field F is effective for suppressing the blurring and color splitting. Moreover, in the above-mentioned lighting scheme for the light source 1, in each field, the period of displaying a black picture from the beginning (time T1) and the period of displaying a black picture until the end (time T4) are maximized, so that the effects of suppressing the blurring and color splitting can be maximized. Further, in each field F, an interval between periods t1 and t2 and an interval between periods t2 and t3 are equalized so that the mixing of the respective colors can be effectively performed.

Further, in this embodiment, the data for the black picture display on the liquid crystal device 3 need not be prepared separately from the respective color picture data of red, green and blue, so that a complicated circuit is not specifically required. (Example)

In a specific example, the lighting periods t1, t2 and t3 in the respective sub-fields t1, t2 and t3 in the respective sub-fields SF1, SF2 and SF3 were each set to occupy 75 % of an associated sub-field period in view of the effects of suppressing the blurring and color splitting in a hold-type display device. This value can be modified based on consideration of other factors. For example, the value can be varied for providing different luminances of respective color picture data to adjust a chromaticity of mixed colors.

Figure 2:
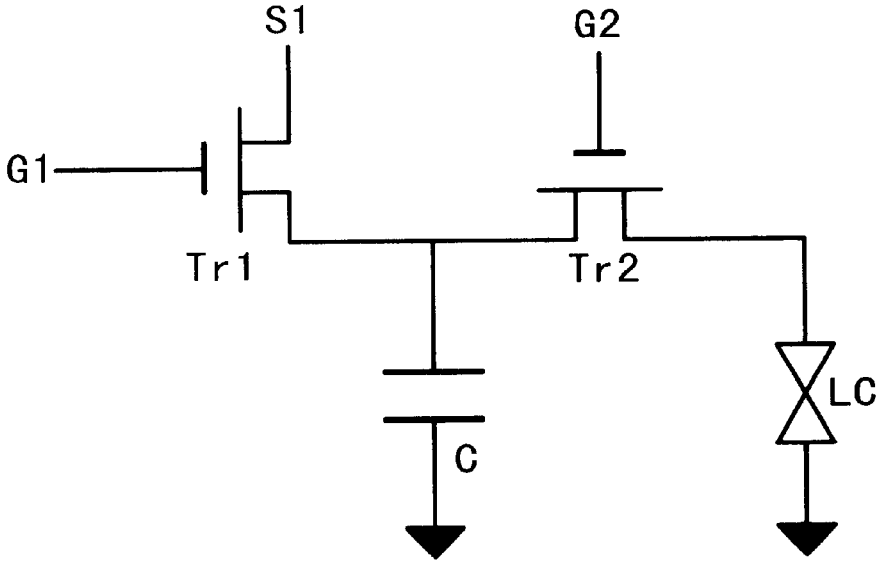
FIG. 2 is a circuit diagram for illustrating a circuit for driving a liquid crystal pixel adopted in an example of liquid crystal device used in the invention.

FIG. 2 shows a pixel circuit organization of a liquid crystal device used in this example. Referring to FIG. 2, the circuit includes a reading TFT transistor Tr1, a memory capacitor C, a writing transistor Tr2, and a liquid crystal pixel LC. In operation, when the transistor Tr1 receives a reading signal G1, the transistor Tr1 is turned on so that picture data S1 is introduced and stored at the memory capacitor C. Then, upon receiving writing signal G2, the transistor Tr2 is turned on so that the stored picture data S1 stored at the memory capacitor C is transferred via the transistor Tr2 to the liquid crystal pixel LC. As a result, the liquid crystal at the pixel is supplied with a voltage depending on the picture data S1 to effect optical switching as shown at FIGS. 1(*a*) and (*b*).

Figure 3:
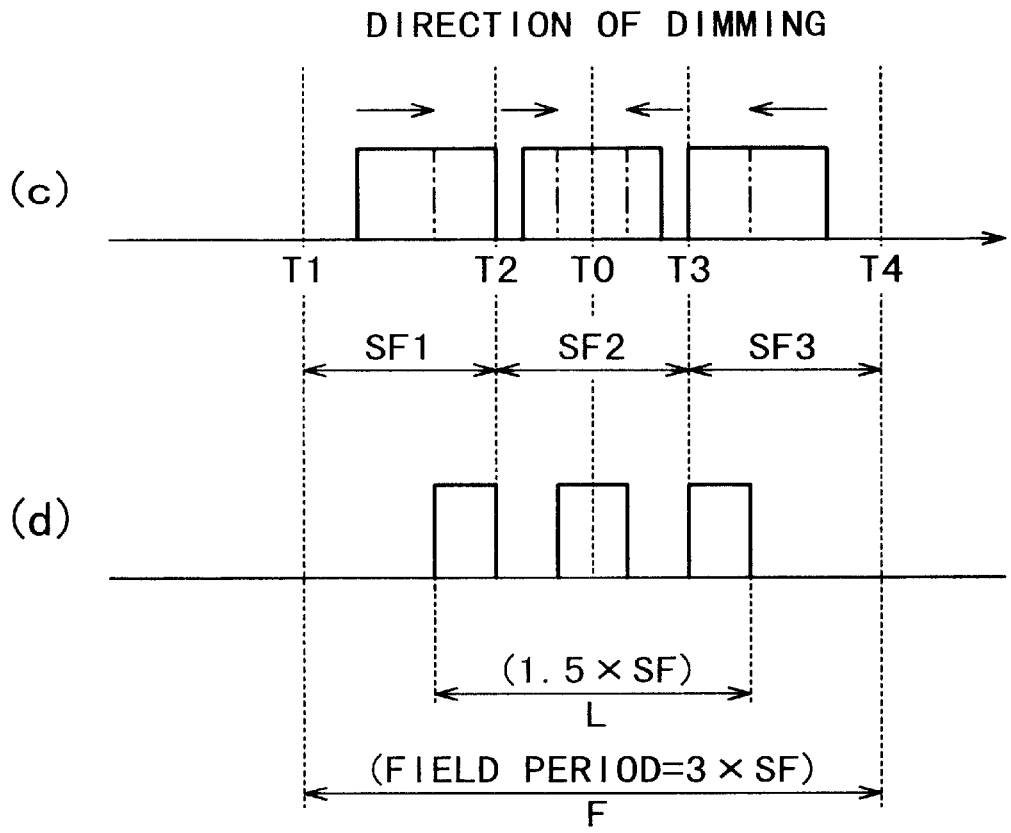
FIG. 3 is a time chart for illustrating a manner of dimming.

FIG. 3 illustrates a manner of dimming the light source. More specifically, FIG. 3(*c*) shows lighting periods of the light source 1 before the dimming (corresponding to FIG. 1(*c*)), and FIG. 3(*d*) shows lighting periods of the light source 1 after the dimming.

As mentioned above, the lighting duty was set at 75 % before the dimming as shown at FIG. 3(*c*), but was reduced to 25 % after the dimming as shown at FIG. 3(*d*). The dimming was effected so as to shorten the lighting periods by extending the former extinction period in the first sub-field SF1, equally extending the former and latter extinction periods in the second sub-field SF2 and extending the latter extinction period in the third sub-field SF3, as indicated by arrows and dots and dash lines at FIG. 3(*c*). As a result of the dimming, the whole lighting period L was reduced to 1.5 times the sub-field SF, thus an apparent lighting duty of 50 %. As a result, the motion picture blurring was further effectively suppressed.

As described above, according to the present invention, the light source is turned off in each step of illumination with primary color light, whereby a black color display period is inserted in each primary color light illumination step to effectively reduce the motion pictures blurring and color splitting.

Further, as the extinction period between the lighting sub-fields for respective primary color lights is shortened, the color splitting is effectively suppressed, and as a relatively broad extinction period is placed between successive field, the motion picture blurring is effectively suppressed.

Further, black picture data for attaining the above effects is not required separate from red, green and blue picture data, so that a complicated circuit is not required as in the prior art.

What is claimed is:

1. A color picture display system using a liquid crystal display apparatus of the type including a light source capable of emitting three primary color lights of R (red), G (green) and B (blue) separately at arbitrary time, and a liquid crystal device for receiving and selectively switching the three primary color lights from the light source;

said system being operable to display a full-color motion picture in a succession of fields each including at least three sub-fields for emitting the color lights of R, G and B, respectively, wherein an extinction period for turning off all the color lights is provided between each pair of successive sub-fields so as to provide the extinction period that is longer when placed between a successive pair of fields than when placed between a successive pair of sub-fields in one field period.

2. A color picture display system according to claim 1, wherein said at least three sub-fields for emitting the color lights of R, G and B have equal lengths of period, and the color lights of R, G and B are emitted for mutually equal lengths of period in the respective sub-fields.

3. A color picture display system according to claim 1, wherein the liquid crystal device comprises a matrix of pixels each comprising a liquid crystal, a capacitor for storing picture data, a first transistor for introducing the picture data to the capacitor, and a second transistor for transferring the picture data stored at the capacitor to the liquid crystal.

4. A liquid crystal display apparatus of the type including a light source capable of emitting three primary color lights of R(red), G(green) and B(blue) separately at arbitrary times, and a liquid crystal device for receiving and selectively switching the three primary color lights from the light source;

said apparatus being operable to display a full-color motion picture in a succession of fields each including at least three sub-fields for emitting the color lights of R, G and B, respectively, wherein a period for displaying a black picture is provided between each pair of successive sub-fields such that the period for displaying the black picture is longer when placed between a successive pair of fields than when placed between a successive pair of sub-fields in one field period.

* * * * *

UNITED STATES PATENT AND TRADEMARK OFFICE

CERTIFICATE OF CORRECTION

PATENT NO. : 6,573,882 B1 
DATED : June 3, 2003
INVENTOR(S) : Hiroshi Takabayashi It is certified that error appears in the above-identified patent and that said Letters Patent is hereby corrected as shown below:

Column 4,
Line 21, “an” should read -- and --; and
Line 62, “back” should read -- black --.

Column 5,
Line 10, “(Example)” should read -- ¶(Example) --.

Column 6,
Line 15, “time,” should read -- times --.

Signed and Sealed this

Eighteenth Day of November, 2003

JAMES E. ROGAN
*Director of the United States Patent and Trademark Office*